US007967629B1

(12) United States Patent
Liu

(10) Patent No.: US 7,967,629 B1
(45) Date of Patent: Jun. 28, 2011

(54) INTERLOCKING CONNECTOR

(75) Inventor: Wei-Ho Liu, Tuncheng (TW)

(73) Assignee: Ta Hsing Electric Wire & Cable Co., Ltd., Taipei (TW)

( * ) Notice: Subject to any disclaimer, the term of this patent is extended or adjusted under 35 U.S.C. 154(b) by 0 days.

(21) Appl. No.: 12/828,699

(22) Filed: Jul. 1, 2010

(51) Int. Cl.
*H01R 13/627* (2006.01)

(52) U.S. Cl. ..... 439/354; 439/686

(58) Field of Classification Search ..... 439/354, 439/686, 695
See application file for complete search history.

(56) References Cited

U.S. PATENT DOCUMENTS

| | | | | |
|---|---|---|---|---|
| 7,241,184 | B2 * | 7/2007 | Kuo | 439/686 |
| 7,780,466 | B1 * | 8/2010 | Wu | 439/354 |
| 7,841,888 | B2 * | 11/2010 | Xia et al. | 439/354 |
| 2003/0017749 | A1 * | 1/2003 | Daugherty et al. | 439/686 |

FOREIGN PATENT DOCUMENTS

| | | |
|---|---|---|
| SG | WO2007/133165 | 11/2007 |

* cited by examiner

*Primary Examiner* — Hien Vu
(74) *Attorney, Agent, or Firm* — Guice Patents PLLC

(57) ABSTRACT

An interlocking connector includes a plug assembly and an appliance socket unit. The plug assembly includes a front hollow seat, an inner seat for receiving a pair of conductive connecting pins, and a rear housing having an extension power line. The inner seat has a front portion received in the front hollow seat, and has a rear portion received in the rear housing. A liftable and closable lid is provided on the top of the inner seat, and a recessed space is formed in the inner seat in opposition to the lid. The front hollow seat has an elastic strip which has a triangular engaging block having a slope and a raised press block. The rear housing has an opening to allow the press block to protrude out of a surface thereof, so that the press block can transmit a force toward the recessed space to displace the engaging block.

8 Claims, 6 Drawing Sheets

INTERLOCKING CONNECTOR

BACKGROUND OF THE INVENTION

1. Field of the Invention

The present invention relates to a connector for power supplying, and especially to an interlocking connector composed of a plug assembly and an appliance socket unit; the present invention also relates to a plug assembly comprised of a front hollow seat, an inner seat and a rear housing.

2. Description of the Prior Art

In the prior art, a PCT International Publication No. WO 2007/133165 A1 "POSITIVE LOCK CONNECTOR" has an interlocking connector disclosed, this interlocking connector can be used for a connector for power supplying and an appliance socket unit for receiving power supplying, this interlocking connector meets the international standard IEC 60320-1.

In this prior art, an interlocking connector structure 8 which includes a connector 10 having a housing, the housing of the connector 10 is mounted with a first electrode terminal for power supplying, the housing is provided thereon with an elastic locking element which can be moved between an external locking position and an internal relieving position. The locking element normally is in its locking position. The structure 8 further has a recess to receive an appliance socket unit 40 of the connector 10, and a second electrode terminal for power supplying; when the connector 10 is received in the recess, it contacts the first electrode terminal, an engaging hole is provided in the recess. The locking element can be mutually interfered with the engaging hole, in order to prevent the connector 10 from being dropped off an entry 12 of a device when the latter is received into the entry 12 of the device; and when the locking element is relieved from interference with the engaging hole, the locking element can allow the connector 10 to be extracted out of the entry 12 of the device by the force that locking element exerts towards the connector 10.

In this prior art, the connector 10 is an integrally formed structure, the first electrode terminal is embedded therein, and a movable elastic locking element is formed on its outside surface for locking the appliance socket unit 40. However, by virtue that the locking element is designed to be moved only when it is pended in the air, if it is shaped integrally, its cost of production will be quite expensive, inferiority of the product is so high that it has no competitiveness in the market; thereby it needs to be improved.

SUMMARY OF THE INVENTION

In view of the above stated, the present invention provides an interlocking connector composed mainly of a plug assembly and an appliance socket unit. Wherein the plug assembly includes a front hollow seat, an inner seat for receiving therein a pair of conductive connecting pins, and a rear housing having an extension power line; the core wire of the power line is electrically connected with the conductive connecting pins; the front portion of the inner seat is received in the front hollow seat, while the rear portion of the inner seat is received in the rear housing; the inner seat at least is provided with two mutually parallel grooves to respectively receive the conductive connecting pins, and is provided in its front portion with two through holes in corresponding by position respectively with the conductive connecting pins; a liftable and closable lid is provided on the top of the inner seat, and a recessed space is formed in the inner seat in opposition to the lid; the front hollow seat is slipped over the front portion of the inner seat and is provided with a pair of holes in corresponding by position respectively with the two through holes, and is provided in corresponding by position to the recessed space of the inner seat with an elastic strip, the elastic strip is provided on its front with a triangular engaging block having a slope and is provided on its end with a raised press block; the rear housing is slipped over the rear portion of the inner seat, and is provided in corresponding by position to the press block with an opening to allow the press block to protrude out of the surface of it, so that the press block can transmit a force toward the recessed space to displace the triangular engaging block.

The appliance socket unit is mounted on an appliance in need of electric power, it has a housing which has an entry with a shape meeting that of the front hollow seat for inserting of the latter, and is provided therein with a pair of conductive pins; when the front hollow seat of the plug assembly is inserted, the pair of conductive pins are extended through the through holes and the aforesaid holes to electrically connect the aforesaid conductive connecting pins; the entry is provided on its inner wall in corresponding by position to the triangular engaging block of the elastic strip with a triangular engaging hole, in order that when the plug assembly is inserted, the triangular engaging block is engaged in the triangular engaging hole to lock the plug assembly together with the appliance socket unit; in pressing the press block, the triangular engaging block is displaced to relieve locking with the triangular engaging hole, thereby the plug assembly can be extracted out of the appliance socket unit.

As compared with the conventional plug assembly which is shaped integrally, the interlocking connector provided in the present invention comprises three components including a front hollow seat, an inner seat and a rear housing, this renders easy designing of the dies for them, hence the present invention has the advantage of simplicity of manufacturing and easiness of assembling, and its competitiveness in the markets can be increased by largely reducing its cost.

The present invention will be apparent in its structural feature and effect of operation after reading the detailed description of the preferred embodiment thereof in reference to the accompanying drawings.

DETAILED DESCRIPTION OF THE PREFERRED EMBODIMENT

Figures 1, 1A, 1B:
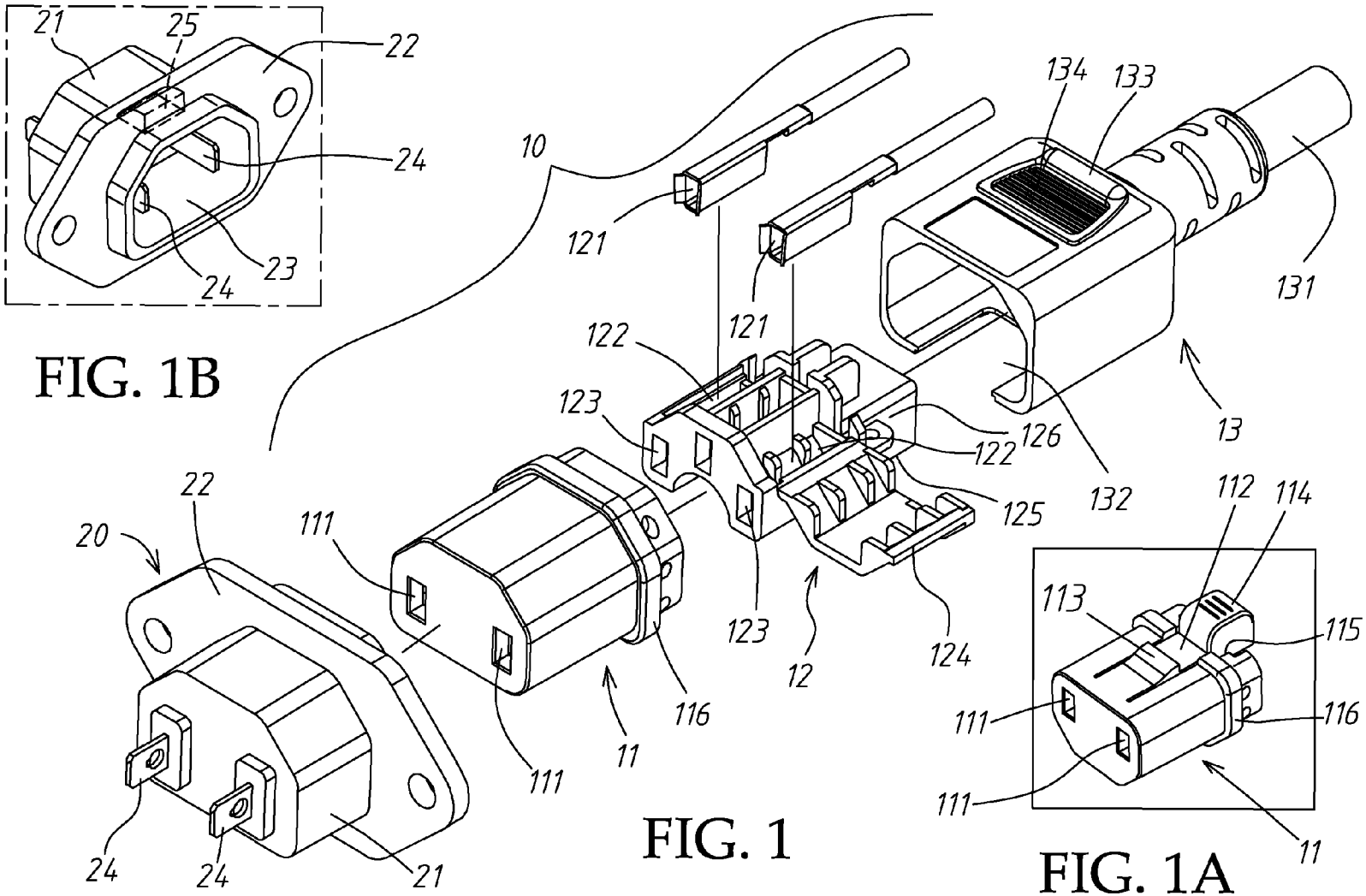
FIG. 1 is an anatomic perspective view of the present invention.
FIG. 1A is a perspective view showing the front hollow seat of the present invention in another angular position.
FIG. 1B is a perspective view showing the appliance socket unit of the present invention in another angular position.
Figure 2:
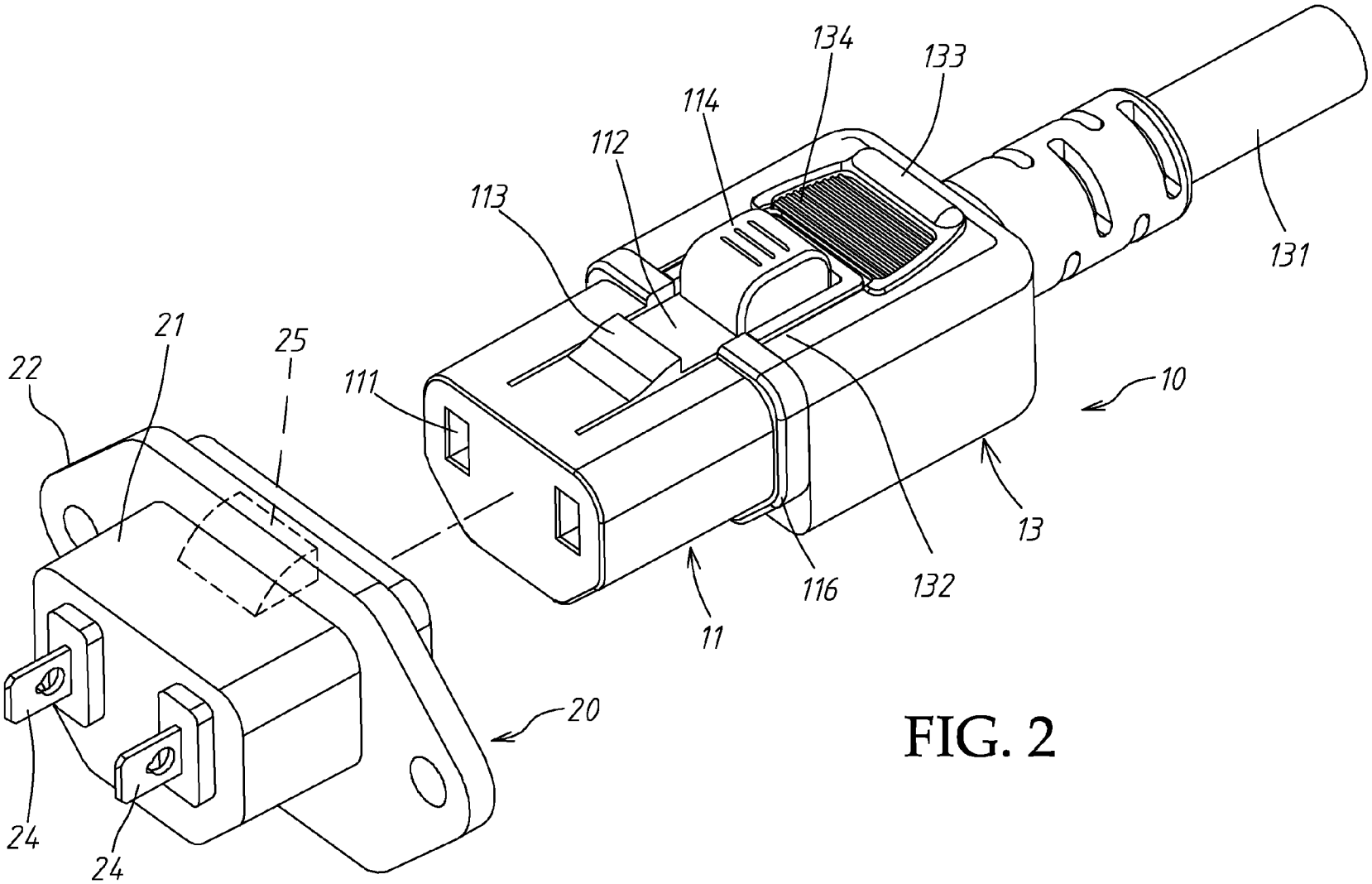
FIG. 2 is a perspective view showing the appliance socket unit and the assembled plug assembly of the present invention.

Referring to FIGS. 1 and 2, the present invention provides an interlocking connector composed mainly of a plug assembly 10 and an appliance socket unit 20.

The plug assembly 10 comprises a front hollow seat 11, an inner seat 12 for receiving therein a pair of conductive connecting pins 121, and a rear housing 13 having an extension power line 131. The core wire of the power line 131 is electrically connected with the conductive connecting pins 121.

Figure 3:
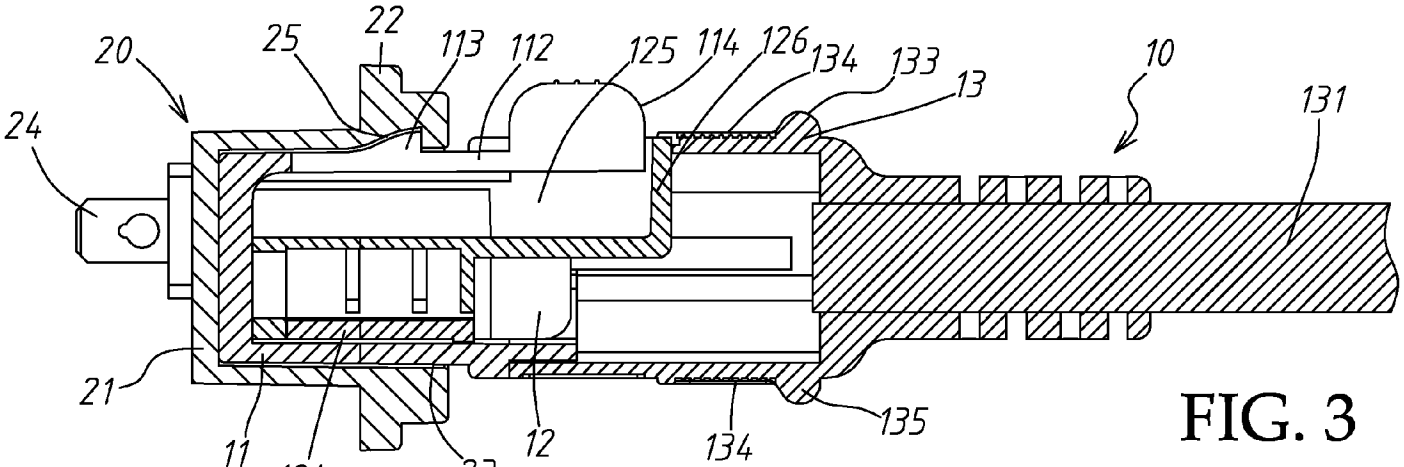
FIG. 3 is a sectional view showing the whole of the present invention after assembling.

The front portion of the inner seat 12 is received in the front hollow seat 11, while the rear portion of the inner seat 11 is received in the rear housing 13 (please refer to FIG. 3); the inner seat 12 at least is provided therein with two mutually parallel grooves 122 to respectively receive the conductive connecting pins 121, and is provided in its front portion with two through holes 123 in corresponding by position respectively with the conductive connecting pins 121; a liftable and closable lid 124 is provided on the top of the inner seat 12 for the convenience of mounting the conductive connecting pins 121, and a recessed space 125 is formed in the inner seat 12 in opposition to the lid 124; the inner seat 12 is provided on the back of it with a protecting frame 126.

Figure 4:
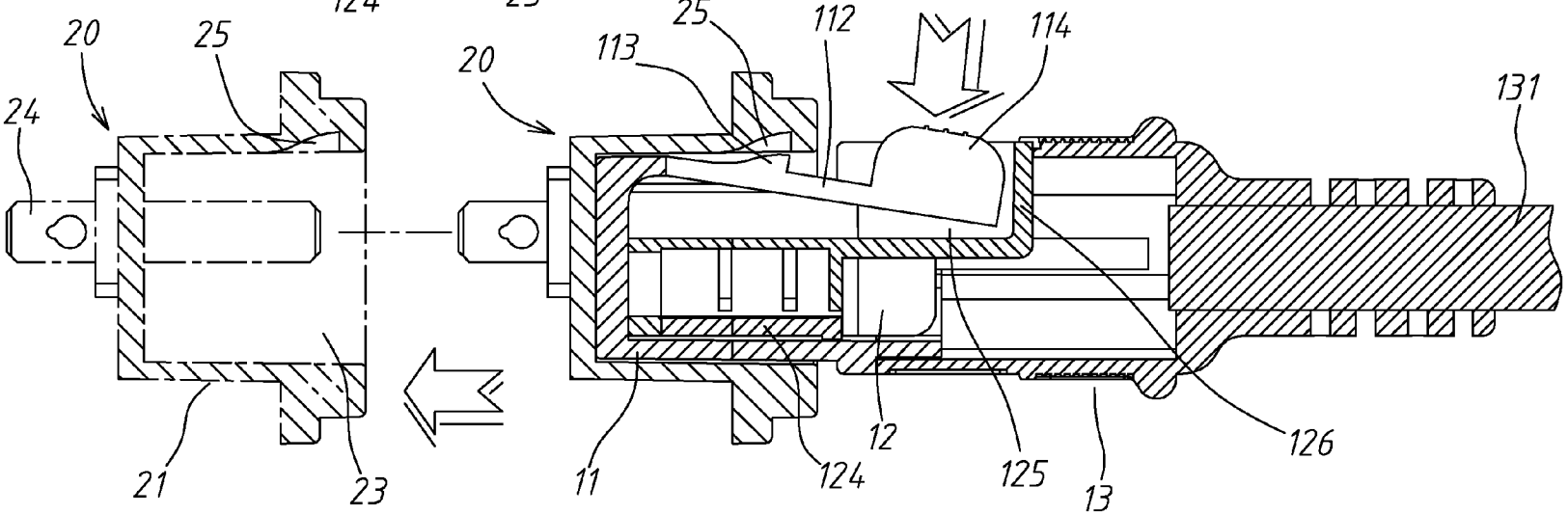
FIG. 4 is a schematic sectional view showing actions of the present invention.
Figure 6:
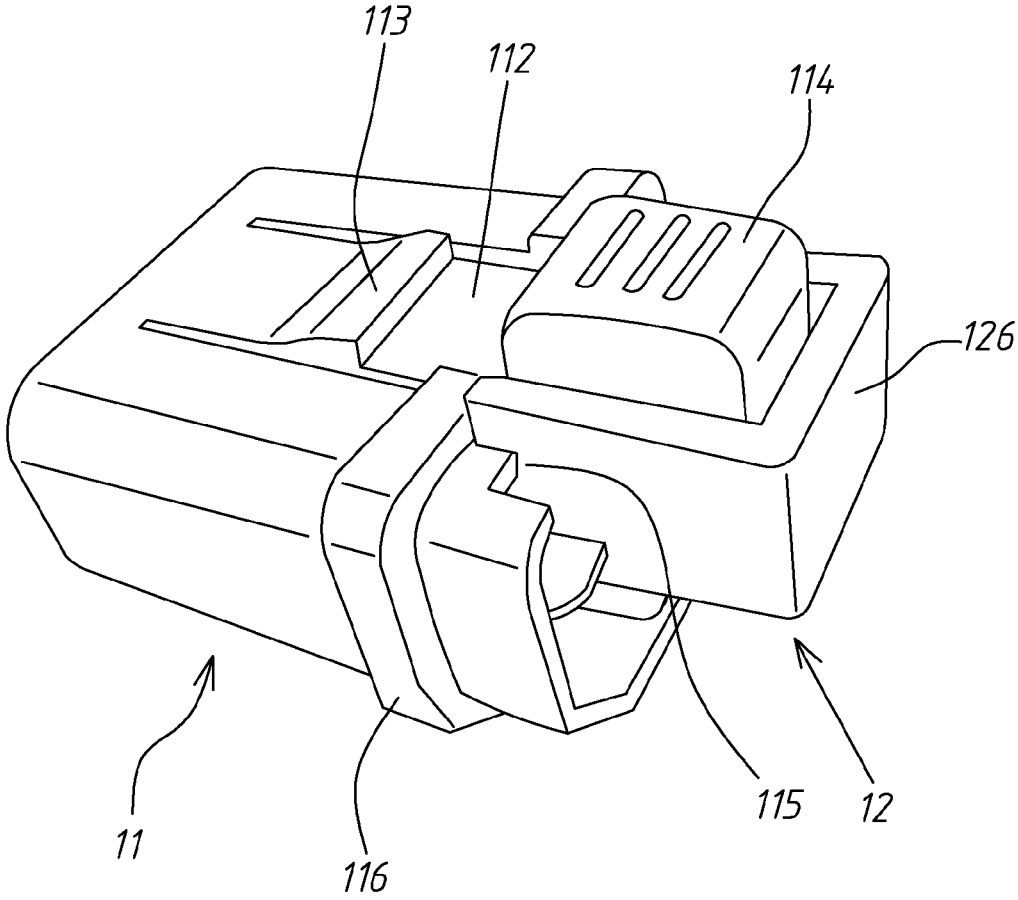
FIG. 6 is a perspective view showing the assembled front hollow seat and inner seat of the of the present invention.

The front hollow seat 11 is slipped over the front portion of the inner seat 12 and is in the shape of "D" generally, and is provided with a pair of holes 111 in corresponding by position respectively with the two through holes 123, and is provided in corresponding by position to the recessed space 125 of the inner seat 12 with an elastic strip 112 as is shown in FIG. 1A, the elastic strip 112 is provided on its front with a triangular engaging block 113 having a slope in the front of it and is provided on its end with a raised press block 114. The press block 114 of the inner seat 12 protrudes out of the rear side of the front hollow seat 11, and two notches 115 are respectively provided between the two lateral sides of the press block 114 and the rear side of the front hollow seat 11, so that the two lateral sides of the protecting frame 126 can be inserted respectively into the two notches 115 to encircle the press block 114 such as is shown in FIG. 6, thereby the space for action of the press block 114 can be limited, and the press block 114 can only be moved by pressing as shown in FIG. 4. The front hollow seat 11 is provided on its surface with a stopping rib 116.

The rear housing 13 is slipped over the rear portion of the inner seat 12, and is provided in corresponding by position to the press block 114 with an opening 132 to allow the press block 114 to protrude out of the surface of it, so that the press block 114 can transmit a force toward the recessed space 125 to displace the triangular engaging block 113 such as is shown in FIG. 4. The front edge of the rear housing 13 can be stopped by the stopping rib 116.

The appliance socket unit 20 of the interlocking connector of the present invention is mounted on an appliance in need of electric power (not shown) in order to accept insertion of the plug assembly 10 for getting electric power. The appliance socket unit 20 has its housing 21 provided with a flange 22 to be connected with an appliance, and has an entry 23 with a shape (being a hole in the shape of "D") meeting that of the front hollow seat 11 for inserting of the front hollow seat 11 therein, such as is shown in FIG. 1B. The housing 21 is provided therein with a pair of conductive pins 24; when the front hollow seat 11 of the plug assembly 10 is inserted, the pair of conductive pins 24 are extended through the holes 111 of the front hollow seat 11 and the through holes 123 of the inner seat 12 to electrically connect the conductive connecting pins 121; the entry 23 is provided on its inner wall in corresponding by position to the triangular engaging block 113 of the elastic strip 112 of the front hollow seat 11 with a triangular engaging hole 25, in order that when the plug assembly 10 is inserted, the triangular engaging block 113 is engaged in the triangular engaging hole 25 to lock the plug assembly 10 together with the appliance socket unit 20 (Please refer to FIG. 3).

When locking of the plug assembly 10 is to be relieved and extracted (such as is shown in FIG. 4), the press block 114 is pressed to make the elastic strip 112 displace the triangular engaging block 113 to be relieved from the triangular engaging hole 25 to relive the locking of it with the triangular engaging hole 25, thereby the plug assembly 10 can be extracted out of the appliance socket unit 20.

Moreover, for the convenience of extracting the plug assembly 10, the rear housing 13 of the plug assembly 10 is provided on its top and its bottom each with a rib 133 having a plurality of slide proofing strips 134 in front of it, for the convenience of grapping by a user.

Figure 5:
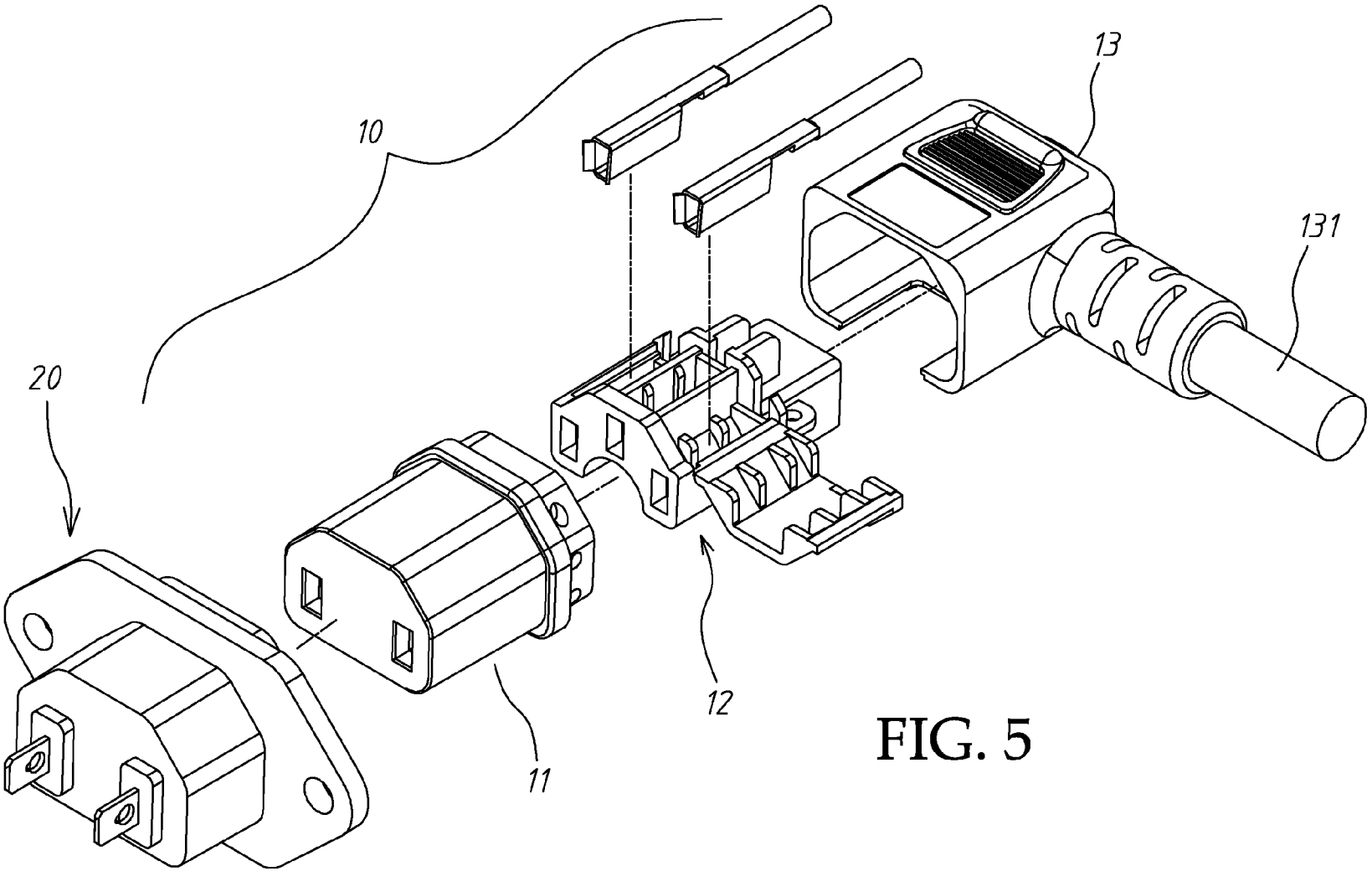
FIG. 5 is an anatomic perspective view showing another embodiment of the present invention wherein the power line of the rear housing is extended out of a lateral side.

In the embodiment as shown in FIGS. 1 and 2, the electric power line 131 of the rear housing 13 of the plug assembly 10 is extended out of the rear side; and as shown in FIG. 5, the power line of the rear housing 13 is extended out of a lateral side.

Evidently, the interlocking connector provided in the present invention is shaped integrally as compared with the conventional plug assembly, hence the present invention has the advantage of simplicity of manufacturing and easiness of assembling, and its competitiveness in the markets can be increased by largely reducing its cost.

Figure 7:
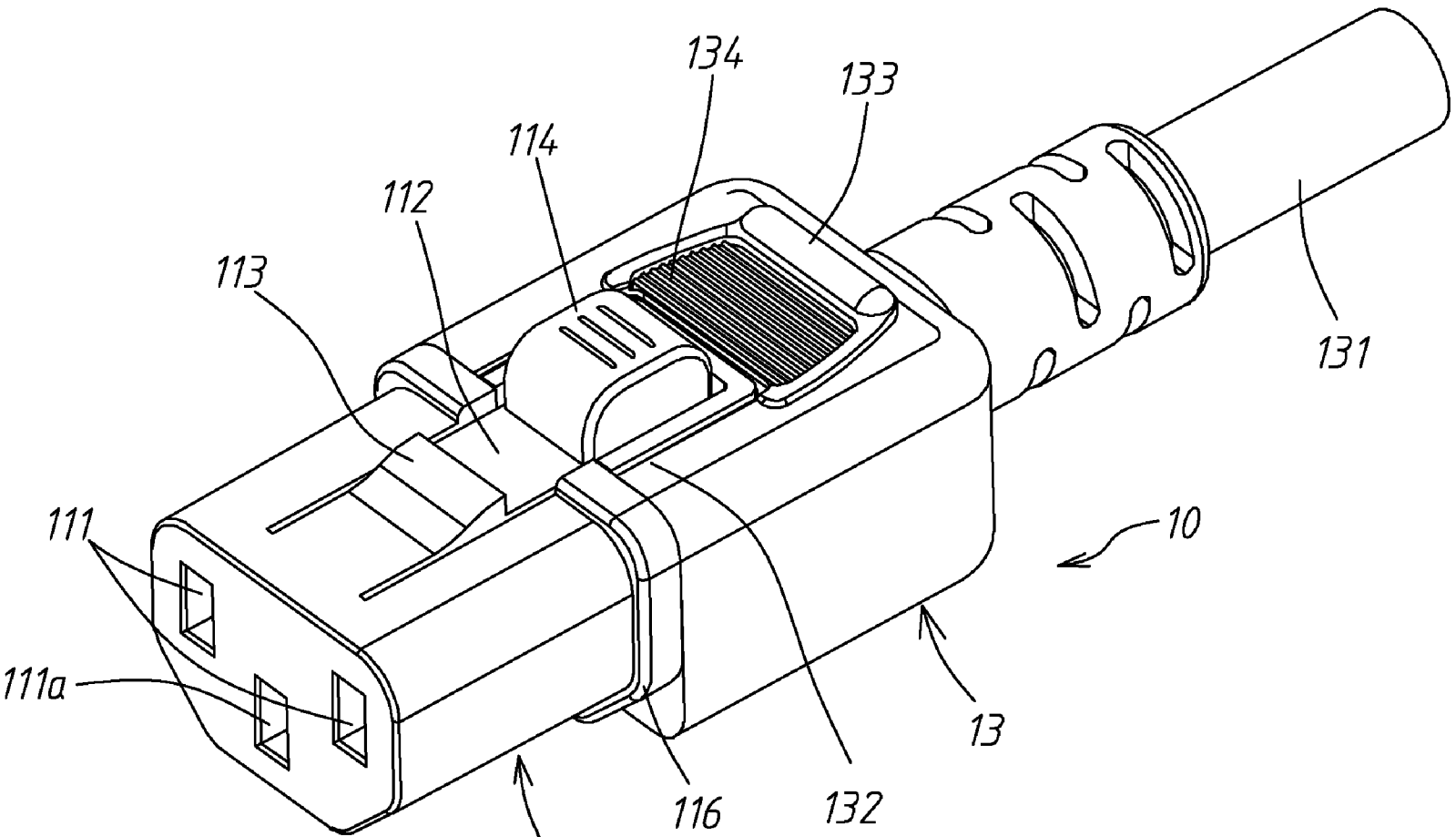
FIG. 7 is an anatomic perspective view showing another embodiment of the plug assembly of the present invention.

Further referring to FIG. 7 which shows another embodiment of the plug assembly 10 of the present invention, the embodiment is similar to the former embodiment, however, the pair of holes 111 in the front of the front hollow seat 11 have between them a third of hole 111*a* to render the plug assembly 10 to have three insertion holes; the appliance socket unit 20 can be added correspondingly with a third conductive pin (not shown); while the inner seat 12 can be provided with a third conductive connecting pin (not shown) to form a grounding structure; these are some simple variations of the present invention, which are similar to those in a normal three-hole connector, and no further description is necessary for them.

In conclusion, the interlocking connector provided in the present invention meets the requirement of patentable elements of novelty and progression; it will be apparent to those skilled in this art that various equivalent modifications or changes can be made to the elements of the present invention without departing from the spirit and scope of this invention.

The invention claimed is:

1. An interlocking connector comprising:

a plug assembly including a front hollow seat, an inner seat receiving therein a pair of conductive connecting pins, and a rear housing having an extension power line; a core wire of said power line is electrically connected with said conductive connecting pins; a front portion of said inner seat is received in said front hollow seat, while a rear portion of said inner seat is received in said rear housing, said inner seat at least is provided with two mutually parallel grooves to respectively receive said conductive connecting pins, and is provided in said front portion with two through holes in corresponding by position respectively to said conductive connecting pins; a liftable and closable lid is attached on top of said inner seat, and a recessed space is formed at the bottom of said inner seat in opposition to said lid; said front hollow seat is slipped over said front portion of said inner seat and is provided with a pair of holes in corresponding by position respectively to said two through holes, and is provided in corresponding by position to said recessed space of said inner seat with an elastic strip thereof, said elastic strip is provided on a front thereof with a triangular engaging block having a slope and is provided on an end thereof with a raised press block; said rear housing is slipped over said rear portion of said inner seat, and is provided in corresponding by position to said press block with an opening to allow said press block to protrude out of a surface of said press block, so that said press block transmits a force toward said recessed space to displace said triangular engaging block; and an appliance socket unit mounted on an appliance in need of electric power, the appliance socket unit has a housing which has an entry with a shape meeting that of said front hollow seat for inserting of said front hollow seat, and is provided therein with a pair of conductive pins; when said front hollow seat of said plug assembly is inserted, said pair of conductive pins having ends are extended through said through holes and said holes to electrically connect said conductive connecting pins; said entry is provided on and inner wall thereof in corresponding by position to said triangular engaging block of said elastic strip with a triangular engaging hole, in order that when said plug assembly is inserted, said triangular engaging block is engaged in said triangular engaging hole to lock said plug assembly together with said appliance socket unit; in pressing said press block, said triangular engaging block is displaced to relieve locking with said triangular engaging hole, thereby said plug assembly is extracted out of said appliance socket unit;

wherein said front hollow seat of said plug assembly is provided around on an outer surface thereof with a stopping rib, a front edge of said rear housing is adapted to being stopped by said stopping rib.

2. The interlocking connector as claimed in claim 1, wherein said front hollow seat of said plug assembly is in a shape of "D", and said entry of said appliance socket unit also is in a shape of "D".

3. The interlocking connector as claimed in claim 1, wherein said press block on said elastic strip of said plug assembly protrudes out of a rear side of said front hollow seat, and two notches are respectively provided between said two lateral sides of said press block and said rear side of said front hollow seat; said inner seat is provided on a back thereof with a protecting frame; two lateral sides of said protecting frame is inserted respectively into said two notches to encircle said press block.

4. The interlocking connector as claimed in claim 1, wherein said rear housing of said plug assembly is provided on a top and bottom thereof each with a rib.

5. The interlocking connector as claimed in claim 4, wherein said rib provided on said top and bottom of said rear housing of said plug assembly has a plurality of slide proofing strips provided in its front.

6. The interlocking connector as claimed in claim 1, wherein said extension power line provided on said rear housing of said plug assembly is extended out of a rear side of said rear housing.

7. The interlocking connector as claimed in claim 1, wherein said extension power line provided on said rear housing of said plug assembly is extended out of a lateral side of said rear housing.

8. A plug assembly plug assembly used for an interlocking connector, being insertion connected with an appliance socket unit mounted on an appliance (in need of electric power) for power supplying, comprising:

a front hollow seat, an inner seat for receiving therein a pair of conductive connecting pins, and a rear housing having an extension power line; a core wire of said power line is electrically connected with said conductive connecting pins; a front portion of said inner seat is received in said front hollow seat, while a rear portion of said inner seat is received in said rear housing, said inner seat at least is provided with two mutually parallel grooves to respectively receive said conductive connecting pins, and is provided in said front portion with two through holes in corresponding by position respectively with said conductive connecting pins; a liftable and closable lid is provided on top of said inner seat, and a recessed space is formed in said inner seat in opposition to said lid; said front hollow seat is slipped over said front portion of said inner seat and is provided with a pair of holes in corresponding by position respectively with said two through holes, and is provided in corresponding by position to said recessed space of said inner seat with an elastic strip, said elastic strip is provided on its front with a triangular engaging block having a slope and is provided on an end thereof with a raised press block; said rear housing is slipped over said rear portion of said inner seat, and is provided in corresponding by position to said press block with an opening to allow said press block to protrude out of a surface of said press block, so that said press block transmits a force toward said recessed space to displace said triangular engaging block;

said appliance socket unit has a housing which has an entry for inserting of said front hollow seat, and is provided therein with a pair of conductive pins; when said front hollow seat of said plug assembly is inserted, said pair of conductive pins having ends are extended through said through holes and said holes to electrically connect said conductive connecting pins; said entry is provided on an inner wall thereof in corresponding by position to said triangular engaging block of said elastic strip with a triangular engaging hole, in order that when said plug assembly is inserted, said triangular engaging block is engaged in said triangular engaging hole to lock said plug assembly together with said appliance socket unit; in pressing said press block, said triangular engaging block is displaced to relieve locking with said triangular engaging hole, thereby said plug assembly is extracted out of said appliance socket unit;

wherein said front hollow seat of said plug assembly is provided around on an outer surface thereof with a stopping rib, a front edge of said rear housing is adapted to being stopped by said stopping rib.

* * * * *